US010235821B1

(12) United States Patent
Drako et al.

(10) Patent No.: US 10,235,821 B1
(45) Date of Patent: Mar. 19, 2019

(54) VIRTUAL DOOR KNOCKER APPARATUS, SYSTEM, AND METHOD OF OPERATION

(71) Applicants: Dean Drako, Austin, TX (US); Steven Van Till, Bethesda, MD (US)

(72) Inventors: Dean Drako, Austin, TX (US); Steven Van Till, Bethesda, MD (US)

(73) Assignee: BRIVO SYSTEMS, LLC, Bethesda, MD (US)

( * ) Notice: Subject to any disclaimer, the term of this patent is extended or adjusted under 35 U.S.C. 154(b) by 0 days.

(21) Appl. No.: 15/816,837

(22) Filed: Nov. 17, 2017

(51) Int. Cl.
*G07C 9/00* (2006.01)

(52) U.S. Cl.
CPC ..... *G07C 9/00119* (2013.01)

(58) Field of Classification Search
CPC ..... G07C 9/00119; G07C 2009/00317; G07C 2009/00325; G07C 2009/00333; G07C 2009/00341; G07C 2009/00349; G07C 2009/00357; G07C 2009/00365; G07C 2009/0038; G07C 2009/00555; G07C 2009/00579; G07C 2009/00587; G07C 2009/00595; G07C 2009/00603; G07C 9/00111; G07C 9/00182; G07C 9/00309; G07C 9/00571
USPC ..... 340/5.61
See application file for complete search history.

(56) References Cited

U.S. PATENT DOCUMENTS

2011/0115823 A1* 5/2011 Huebner ..... G03B 21/14 345/661
2016/0300048 A1* 10/2016 Mason ..... G06F 21/31
2017/0154483 A1* 6/2017 Cordiner ..... H04W 4/30
2018/0089916 A1* 3/2018 Drako ..... H04W 12/08
2018/0108192 A1* 4/2018 Ho ..... G06K 9/00288
2018/0146374 A1* 5/2018 Golan ..... H04L 63/083
2018/0158266 A1* 6/2018 Zizi ..... G06F 21/32
2018/0262891 A1* 9/2018 Wu ..... H04W 4/00
2018/0268675 A1* 9/2018 Johnson ..... G08B 13/19695

* cited by examiner

*Primary Examiner* — Hirdepal Singh
(74) *Attorney, Agent, or Firm* — Patentry; Peter G. H. Hwang

(57) ABSTRACT

A door opens for an authenticated user by being tapped by a communication device. A physical access control system actuates upon receiving a wireless request triggered by a pattern of indicia in the vicinity of a portal. A hand-held communication device transmits a portal access control signal when it recognizes a pattern of bursts in signal amplitude. A mobile device has a sensor package, communication circuits, and a processor. Upon determining proximity to a controlled portal, the sensor package enables a pattern recognition circuit. Upon receiving a success indicia from the pattern recognition circuit, the communication circuits authenticate with the controlled portal, e.g. causing a door to open. A sensor package may be enabled by accelerations from bumping the device; tapping the device against a door, wall, or table. A pattern may be related to a number, or a sequence, or combination of slows, pauses, and quicks, or a single acceleration.

1 Claim, 9 Drawing Sheets

VIRTUAL DOOR KNOCKER APPARATUS, SYSTEM, AND METHOD OF OPERATION

CROSS-REFERENCES TO RELATED APPLICATIONS

None.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISK OR AS A TEXT FILE VIA THE OFFICE ELECTRONIC FILING SYSTEM (EFS-WEB)

Not Applicable

STATEMENT REGARDING PRIOR DISCLOSURES BY THE INVENTOR OR A JOINT INVENTOR

Not Applicable

BACKGROUND OF THE INVENTION

Technical Field

The present invention relates physical access control systems such as electronic door openers.

Description of the Related Art

Cipher locks, card keys, and mobile devices are used to identify authorized users at electronically controlled doors. Generally these must be presented to a recognition panel or sensor next to the door.

As is known, a conventional system operates by manually presenting a Bluetooth configured phone to a Bluetooth panel, rotating it clockwise by 90 degrees and then anti-clockwise by 90 degrees.

As is known, another conventional system operates by manually pocketing a Bluetooth configured phone in the vicinity of a Bluetooth panel, and patting the operator's pocket containing the Bluetooth configured phone.

What is needed is a physical access control system which supports a simpler user model, fewer wired components, and less unintuitive manual manipulation.

SUMMARY OF THE INVENTION

A door opens for an authenticated user upon being viewed or tapped by a communication device. A physical access control system actuates upon receiving a wireless request triggered by a pattern of impacts upon a surface of a portal. A hand-held communication device transmits a portal access control signal when it recognizes a pattern of physical measurements or optical images.

A mobile device has a sensor package, communication circuits, and a processor. Upon determining proximity to a controlled portal, the sensor package enables a pattern recognition circuit. Upon receiving a success indicia from the pattern recognition circuit, the communication circuits authenticate with the controlled portal, ie., opening a door.

A sensor package may be enabled by light energy; sound energy; kinetic energy; accelerations from squeezing the device; shaking the device; waving the device; tapping the device against a door, wall, or table; or forcefully pointing/elevating the device. A pattern may be related to a number, or a sequence, or combination of slows, pauses, and quicks, or a single acceleration.

BRIEF DESCRIPTION OF THE SEVERAL VIEWS OF THE DRAWINGS

To further clarify the above and other advantages and features of the present invention, a more particular description of the invention will be rendered by reference to specific embodiments thereof that are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DISCLOSURE OF EMBODIMENTS OF THE INVENTION

Figure 1:
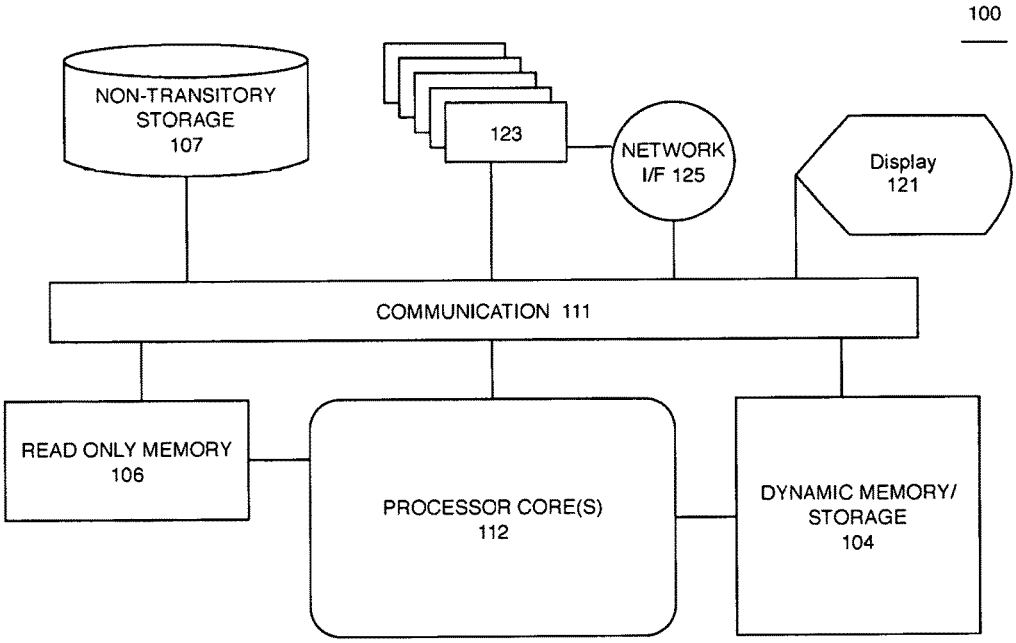
FIG. 1 is a block diagram of a circuit or processor apparatus for performing method steps encoded on tangible non-transitory computer readable media.

A system uses sensors such as a camera, a microphone, and an accelerometer in a mobile phone to initiate a physical access control process wirelessly.

Modules of the system include:

Communications device with sensors such as:

GPS receiver

Accelerometer

WiFi radio

Microphone

Photo optical sensor (e.g. camera)

In an embodiment, a Fixed receiver (reader): A fixed reader consisting of communications circuits and a processor.

Portal Controller: A communications and computing device that may also include electromechanical relays.

Portal locking mechanism consisting of at least one of: electromechanical door strike, wireless door lock, electromechanical gate, electromechanical turnstile, electromechanical garage door opener, elevator control system, electromechanical cabinet lock.

Provisioning server consisting of a computing system with one or more processors, RAM, and non-volatile storage plus application software to configure and manage the at least one communications device, and at least one portal controller.

Credentialing server consisting of a computing system with one or more processors, RAM, and non-volatile storage plus application software to create, manage, and deliver at least one valid credential to at least one communications devices (1) and at least one portal controller.

One aspect of the invention is a mobile device for physical access control by positional impulses comprising: a processor and computer-readable instruction store; coupled to all of, a sensor package; a pattern recognition circuit; and a communication circuit.

In an embodiment, said sensor package comprises at least one photo sensor (camera); and wherein said pattern recognition circuit triggers on a QR code, a motion vector of a QR code, plurality of non-visible spectrum light impulses or sequence of impulses separated by at least one interval of time.

In an embodiment, said sensor package comprises at least one microphone; and wherein said pattern recognition circuit triggers on a plurality of tones, sounds, words, bursts of amplitude, or sequence of audio energy measurements separated by at least one interval of time.

In an embodiment, said sensor package comprises at least one accelerometer; and wherein said pattern recognition circuit triggers on a plurality of impulses or sequence of impulses separated by at least one interval of time.

In an embodiment, said communication circuit provides the processor with an indicia of proximity by receiving and transforming strengths of radio signals to determine a location and transmits an access request for said portal upon successful pattern recognition.

In an embodiment, said sensor package comprises at least one geolocation circuit; and wherein said circuit provides a geographic location signal that selects among multiple credentials as required to match available credentials stored in the communications device to the portal at which the user is attempting to gain access.

In an embodiment, said sensor package comprises at least one WiFi radio circuit; and wherein said circuit provides a location signal based on WiFi SSID that selects among multiple credentials as required to match available credentials stored in the communications device to the portal at which the user is attempting to gain access.

In an embodiment, said sensor package comprises at least one Bluetooth radio circuit; and wherein said circuit provides a location signal based on Bluetooth beacons that selects among multiple credentials as required to match available credentials stored in the communications device to the portal at which the user is attempting to gain access.

Figure 2:
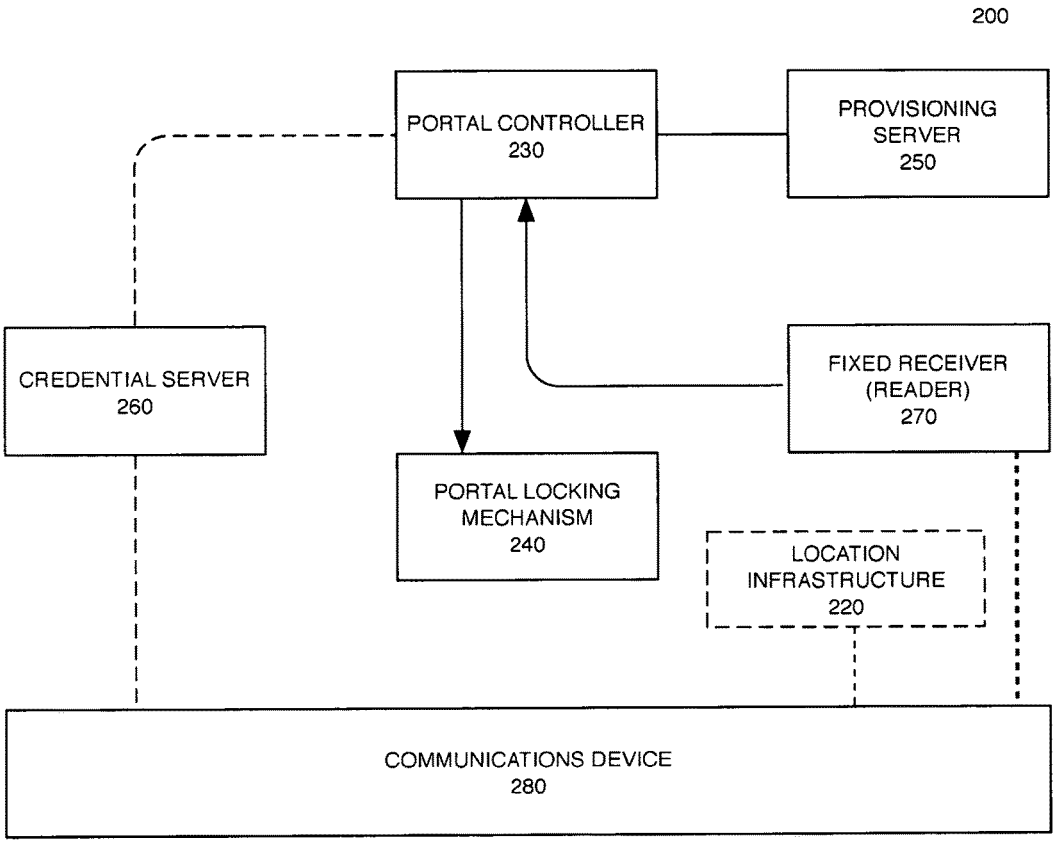
FIG. 2 is a block diagram of a virtual door knocker system.

FIG. 2 is a block diagram of a system 200, which is comprised of, at least one Location infrastructure 220 such as non-limiting exemplary transmitters associated with cellular base stations, global positioning satellites, WiFi access points, and other recognizable landmarks; a portal controller 230; said portal controller coupled to, a portal locking mechanism 240; and further coupled to, a provisioning server 250; and further coupled to, a credential server 260 by a network; and a communications device 280 coupled by a wireless network to said credential server, at least one exemplary location infrastructure 220, and further coupled by a wireless network to said fixed receiver (reader) 270. In an embodiment, said portal controller is further coupled to, a fixed receiver (reader) 270.

Figure 3:
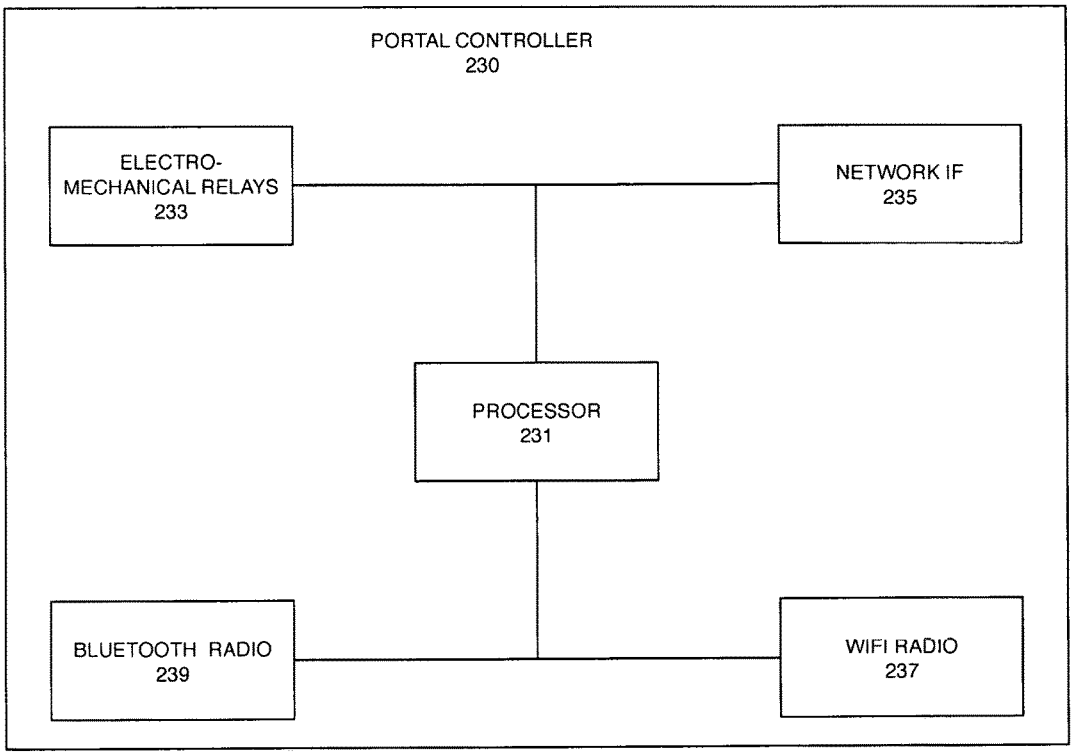
FIG. 3 is a block diagram of the portal controller.

Referring now to FIG. 3. A portal controller 230 apparatus comprises: at least one processor or processor core 231; and a network interface 255. In an embodiment, the controller has at least one communication circuit to couple wired or wirelessly by WiFi 237. In an embodiment, the controller has at least one communication circuit to couple by Bluetooth 239. In an embodiment, the portal controller further comprises at least one electro-mechanical relay 233 to actuate a portal locking mechanism.

Figure 4:
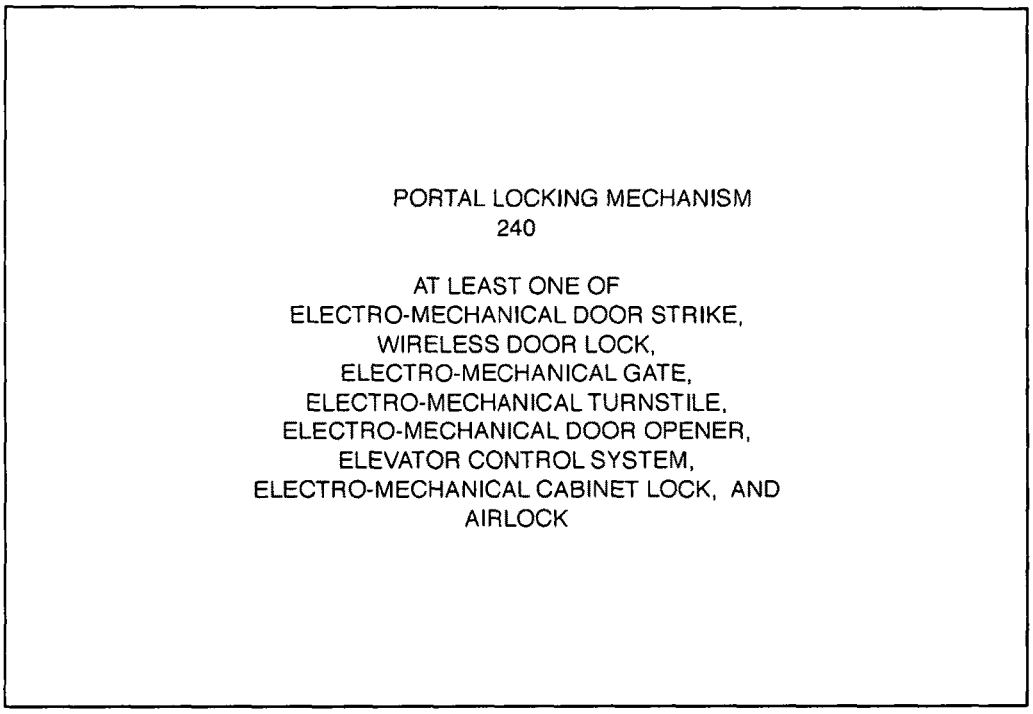
FIG. 4 is a block diagram of the portal locking mechanism.

Referring now to FIG. 4, a portal locking mechanism 240 apparatus comprises: at least one of electro-mechanical door strike, wireless door lock, electro-mechanical gate, electro-mechanical door opener, elevator control system, electro-mechanical cabinet lock, and airlock.

Figure 5:
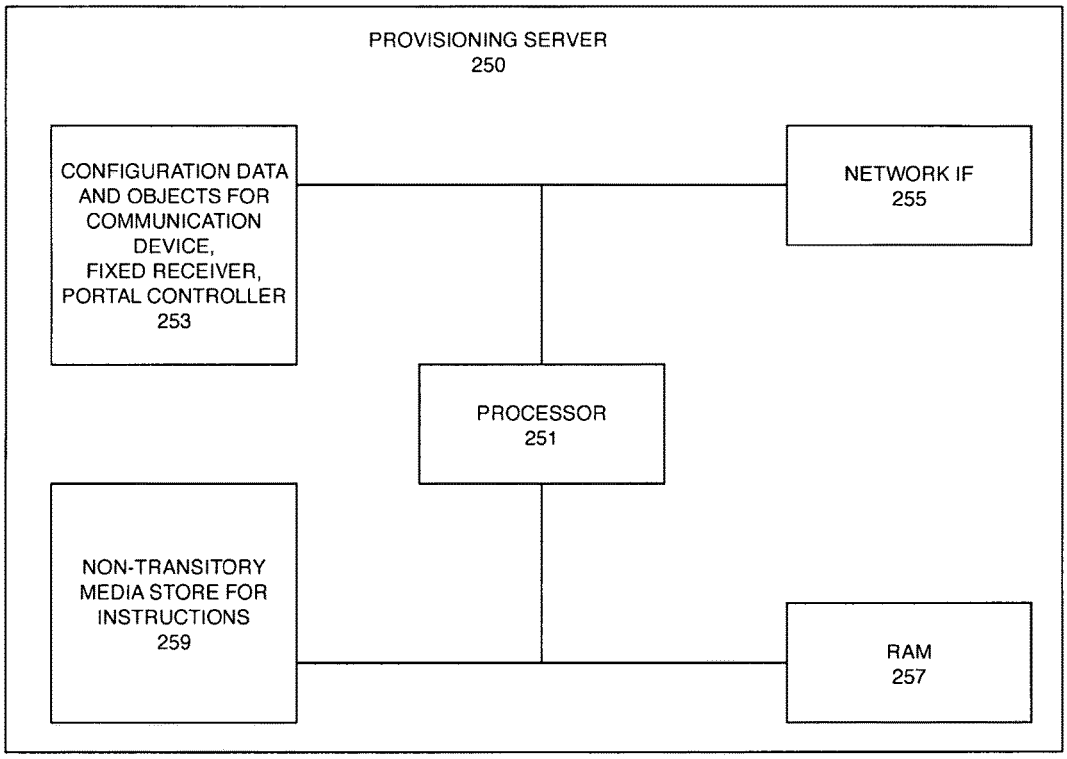
FIG. 5 is a block diagram of the provisioning server.

Referring now to FIG. 5, a provisioning server 250 apparatus comprises: at least one processor or processor core 251; a network interface 255; random Access Memory (RAM) 257; non-transitory media store for application software instructions 259; and configuration data and objects, tangible encoded in non-transitory media for at least one communication device, and at least one portal controller. In an embodiment, FIG. 5 also includes a fixed receiver.

Figure 6:
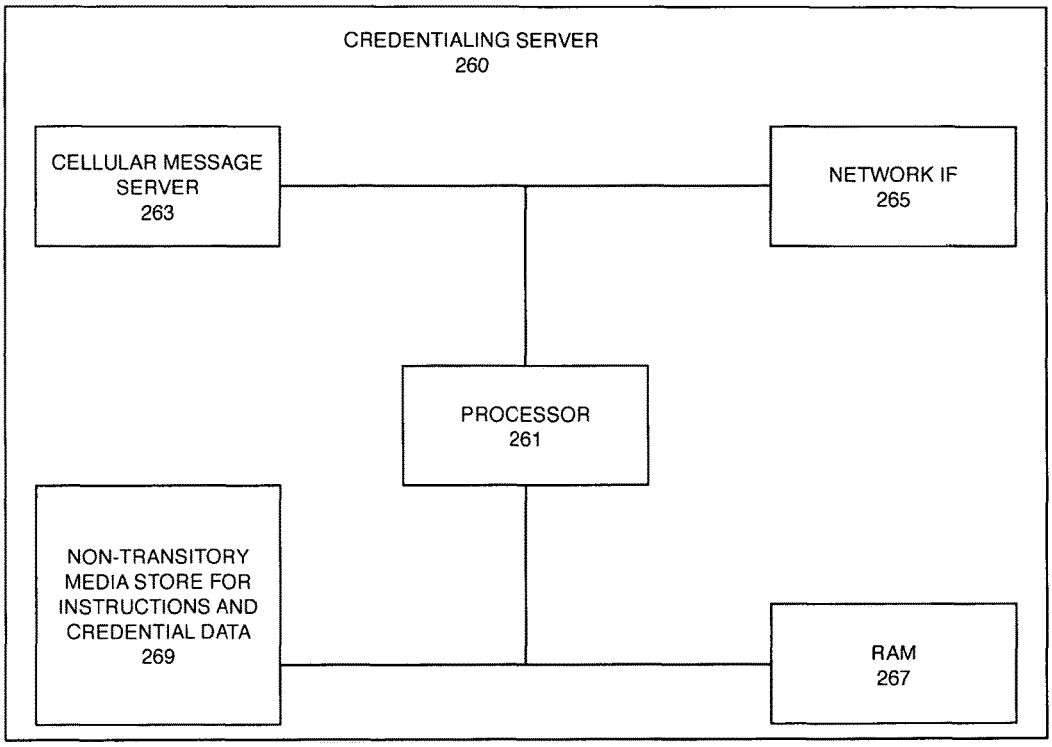
FIG. 6 is a block diagram of the credential server.

Referring now to FIG. 6, a credentialing server 260 apparatus comprises: at least one processor or processor core 261; a network interface 265; random access memory (RAM) 267; and a non-transitory media store for instructions and credential data 269. In an embodiment, the credentialing server further comprises a cellular message server 263 whereby valid a credential are delivered to a communication device upon authentication.

Figure 7:
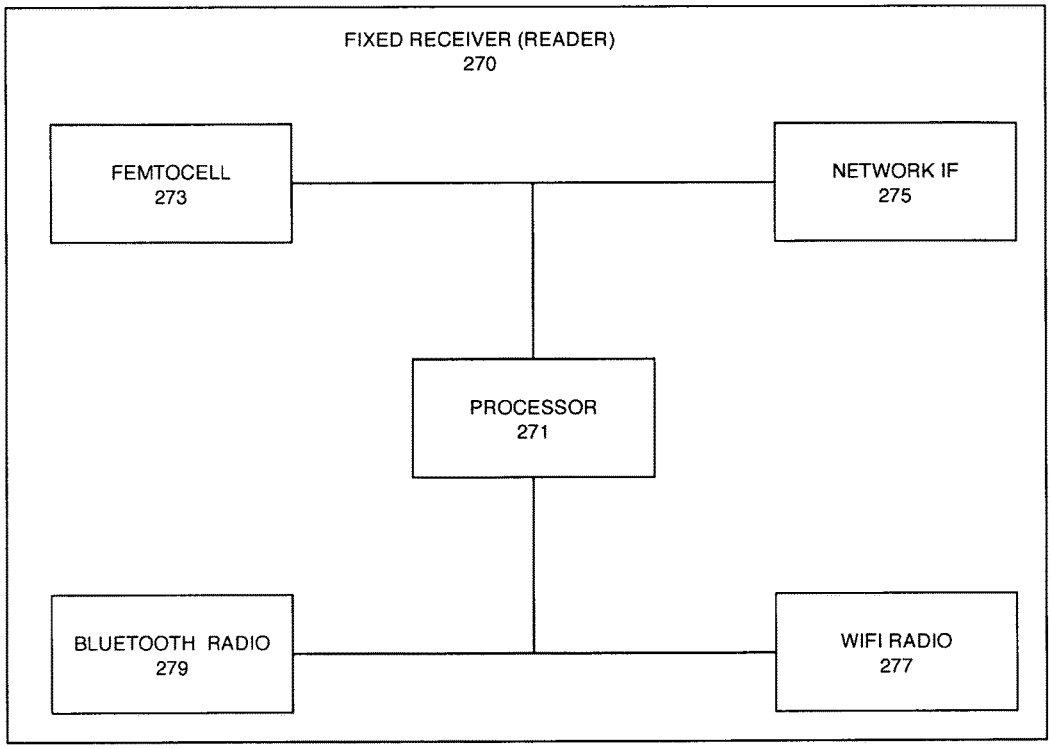
FIG. 7 is a block diagram of the fixed receiver (reader).

Referring now to FIG. 7, in an embodiment, a Fixed Receiver (Reader) 270 apparatus comprises: at least one processor 271; and a network interface 275. As is known, processors within this disclosure are defined to include baseband processors and application processors, monolithic or integrated. In embodiments the apparatus further includes short range radios such as but not limited to femtocell 273, and WiFi 277. In an embodiment, short range radios include Bluetooth 279.

Figure 8:
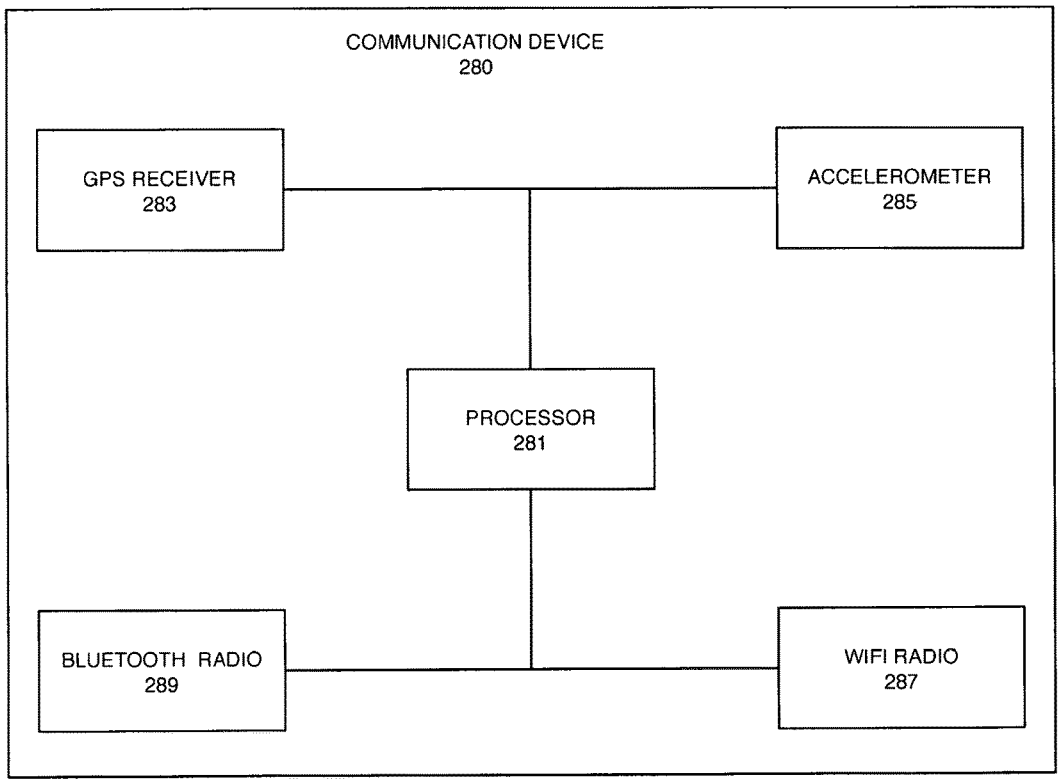
FIG. 8 is a block diagram of the communication device.

Referring now to FIG. 8, a block diagram of a communication device 280, an apparatus comprises: at least one processor 281; and an accelerometer 285. In embodiments, the apparatus further comprises at least one of a GPS receiver 283, and a WIFi Radio 287. In an embodiment, the apparatus further includes a Bluetooth Radio 289. As is known, processors within this disclosure are defined to include baseband processors and application processors, monolithic or integrated.

Figure 9:
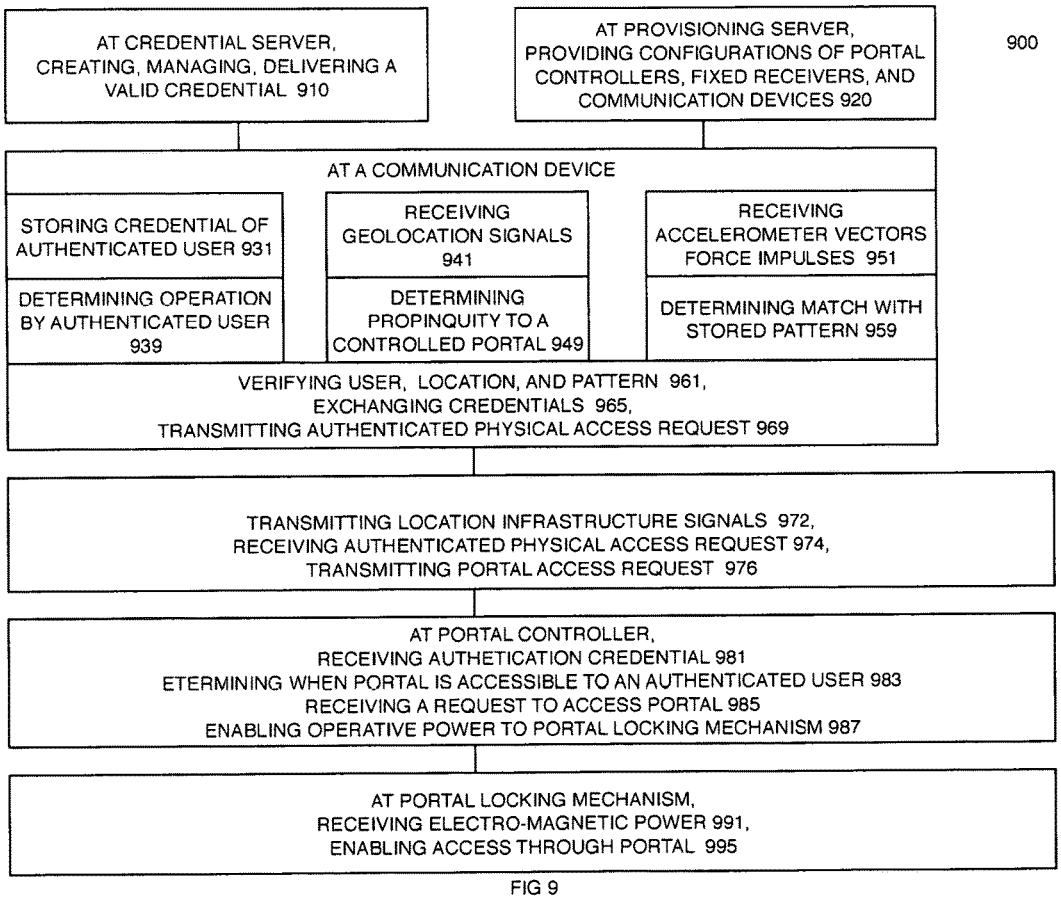
FIG. 9 is a flowchart of the processes of the virtual door knocker system.

Referring now to FIG. 9, a method of operation for a Virtual Door Knocker system includes a plurality of processes such as but not limited to:

In an embodiment, at a communications device with sensors, the processes include performing in parallel or overlap, storing a credential associated with an authenticated user; determining operation by the authenticated user; receiving geolocation signals; determining propinquity to a controlled portal; receiving photo-optical measurements corresponding to images, QR codes, or non-visible spectrum light energy impulses; determining a match with a stored images or pattern of light energy impulses; and upon verification of user, location, and patterns, exchanging credentials and transmitting a physical access request. In an embodiment the physical access request is transformed by each unique QR code.

In an embodiment, at a communications device with sensors, the processes include performing in parallel or overlap, storing a credential associated with an authenticated user; determining operation by the authenticated user; receiving geolocation signals; determining propinquity to a controlled portal; receiving sound energy measurement corresponding to tones, whistles, words, bursts of noise impulses; determining a match with a stored pattern of sound energy impulses; and upon verification of user, location, and pattern of impulses, exchanging credentials and transmitting a physical access request.

In an embodiment, at a communications device with sensors, the processes include performing in parallel or overlap, storing a credential associated with an authenticated user 931; determining operation by the authenticated user 939; receiving geolocation signals 941; determining propinquity to a controlled portal 949; receiving accelerometer measurement vectors corresponding to force impulses 951; determining a match with a stored pattern of force impulses 959; and upon verification of user, location, and pattern of impulses 961, exchanging credentials 965 and transmitting a physical access request 969. In an embodiment a fixed receiver is intermediary to geolocation signals, and physical access request.

In an embodiment, the process includes receiving an authenticated physical access request 974 from a communication device in vicinity of a controlled portal; and transmitting the request to a portal controller 976. In an embodiment, transmitting location infrastructure signals by short range radio 972.

At a credential server, the process includes creating, managing, and delivering at least one valid credential to at least one communication device and to at least one portal controller 910.

At a provisioning server, the process includes providing to a portal controller, configurations of portal controllers, fixed receivers, and communication devices 920 which conditionally support physical access control at time and place.

At a portal controller, the process includes receiving an authentication credential from a credential server 981; determining from a provisioning server a condition when a portal is accessible to an authenticated user 983; receiving a request to access a portal 985 by a configured communication device; and, enabling operative power to a portal locking mechanism 987.

At a portal locking mechanism, the process includes receiving electro-magnetic power 991 to actuate an electromechanical device; and enabling access through a portal 995.

Conclusion

The aspects of the invention are clearly distinguishable from conventional solutions that depend on mobile Bluetooth transmitters and receivers.

The aspects of the invention are clearly distinguishable from conventional solutions that depend on a fixed Bluetooth appliance for each door.

In an embodiment, the sensor package comprises at least one accelerometer; and the pattern recognition circuit triggers on an irregular sequence of impulses separated by at least one interval of time.

The present invention improves the ease of use of physical access control system by allowing intuitive operation of a phone as a door knocker on or in the vicinity of a controlled portal. In an embodiment, a communication device is a wearable "hands-free" device, and a sensor is a microphone to transform sound energy.

A pattern recognition circuit recognizes DTMF tones, voice, whistling, humming, spoken words, and knocks on a door, wall, or table in the geolocation vicinity of the controlled portal.

In an embodiment, a communication device is a wearable "hands-free" device, and a sensor is a camera to transform images.

A pattern recognition circuit recognizes infrared light pulses, a QR code attached to the door, masking and unmasking the sensor to light, a particular combination of e-m frequencies (colors or invisible spectra).

In an embodiment, geolocation is obtained by triangulation of signal strengths from a plurality of femto cell transmitters and/or Wi-Fi access points.

FIG. 1 is a block diagram of at least one exemplary processor suitable for performing the steps of a method embodiment of the invention.

The techniques described herein can be implemented in digital electronic circuitry, or in computer hardware, firmware, software, or in combinations of them. The techniques can be implemented as a computer program product, i.e., a computer program tangibly embodied in a non-transitory information carrier, e.g., in a machine-readable storage device, for execution by, or to control the operation of, data processing apparatus, e.g., a programmable processor, a computer, or multiple computers. A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a communication network.

Method steps of the techniques described herein can be performed by one or more programmable processors executing a computer program to perform functions of the invention by operating on input data and generating output. Method steps can also be performed by, and apparatus of the invention can be implemented as, special purpose logic circuitry, e.g., an FPGA (field programmable gate array) or an ASIC (application-specific integrated circuit). Modules can refer to portions of the computer program and/or the processor/special circuitry that implements that functionality.

Processors suitable for the execution of a computer program include, by way of example, both general and special purpose microprocessors, and any one or more processors of any kind of digital computer. Generally, a processor will receive instructions and data from a read-only memory or a random-access memory or both. The essential elements of a computer are a processor for executing instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. Information carriers suitable for embodying computer program instructions and data include all forms of non-volatile memory, including by way of example semiconductor memory devices, e.g., EPROM, EEPROM, and flash memory devices; internal hard disks or removable disks. The processor and the memory can be supplemented by, or incorporated in special purpose logic circuitry.

FIG. 1 is a block diagram of an exemplary processor that may be used to perform one or more of the functions described herein. Referring to FIG. 1, processor 100 may comprise an exemplary client or server process. Processor 100 comprises a communication mechanism or bus 111 for communicating information, and a processor core 112 coupled with bus 111 for processing information. Processor core 112 comprises at least one processor core, but is not limited to a processor core, such as for example, ARM™, Pentium™, etc.

Processor 100 further comprises a random-access memory (RAM), or other dynamic storage device 104 (referred to as main memory) coupled to bus 111 for storing information and instructions to be executed by processor 112. Main memory 104 also may be used for storing temporary variables or other intermediate information during execution of instructions by processor core 112.

Processor 100 also comprises a read only memory (ROM) and/or other static storage device 106 coupled to bus 111 for storing static information and instructions for processor core 112, and a non-transitory data storage device 107, such as a magnetic storage device or flash memory and its associated control circuits. Data storage device 107 is coupled to bus 111 for storing information and instructions.

Processor 100 may further be coupled to a display device 121 such a flat panel display, coupled to bus 111 for displaying information to a computer user. Voice recognition, optical sensor, motion sensor, microphone, keyboard, touch screen input, and pointing devices 123 may be attached to bus 111 or a network interface (wired or wireless) 125 for communicating selections and command and data input to processor core 112.

It is understood that the processor may be embedded within other circuits of the system as an embodiment of an ARM core or equivalent or as a virtual machine within a multi-core server.

A number of embodiments of the invention have been described. Nevertheless, it will be understood that various modifications may be made without departing from the spirit and scope of the invention. For example, other network topologies may be used. Accordingly, other embodiments are within the scope of the following claims.

We claim:

1. A method of operation for a Virtual Door Knocker system includes processes comprising:

at a communications device with sensors, storing a credential associated with an authenticated user;

determining operation by the authenticated user;

receiving geolocation signals;

determining propinquity to a controlled portal;

receiving accelerometer measurement vectors corresponding to force impulses;

determining a match with a stored pattern of force impulses;

upon verification of user, location, and pattern of impulses, exchanging credentials and transmitting a physical access request;

receiving on a wireless communication network, an authenticated physical access request from the communication device in vicinity of the controlled portal; and transmitting the request to a portal controller;

at a credential server, creating, managing, and delivering at least one valid credential to at least one communication device from a plurality of communication devices and to at least one portal controller from a plurality of portal controllers;

at a provisioning server, providing to the portal controller, configurations of the plurality of portal controllers, and the plurality of communication devices which conditionally support physical access control at the time and place;

at the portal controller, receiving an authentication credential from the credential server;

determining from the provisioning server a condition when the portal is accessible to the authenticated user;

receiving the request to access the portal by the configured communication device; and enabling operative power to a portal locking mechanism;

at the portal locking mechanism, receiving electro-magnetic power to actuate an electro-mechanical device; and enabling access through the portal.

* * * * *